US010676885B2

(12) United States Patent
Baek

(10) Patent No.: US 10,676,885 B2
(45) Date of Patent: Jun. 9, 2020

(54) SHOCK ABSORBER OF ROAD

(71) Applicant: Kyoungpa Baek, Seoul (KR)

(72) Inventor: Kyoungpa Baek, Seoul (KR)

( * ) Notice: Subject to any disclaimer, the term of this patent is extended or adjusted under 35 U.S.C. 154(b) by 0 days.

(21) Appl. No.: 16/159,746

(22) Filed: Oct. 15, 2018

(65) Prior Publication Data

US 2019/0323188 A1 Oct. 24, 2019

(30) Foreign Application Priority Data

Apr. 19, 2018 (KR) ..... 10-2018-0045831

(51) Int. Cl.
*E01F 15/14* (2006.01)
*E01F 15/04* (2006.01)
*E01F 15/08* (2006.01)

(52) U.S. Cl.
CPC ..... *E01F 15/146* (2013.01); *E01F 15/0453* (2013.01); *E01F 15/0461* (2013.01); *E01F 15/086* (2013.01); *E01F 15/0484* (2013.01)

(58) Field of Classification Search
CPC ..... E01F 15/02; E01F 15/025; E01F 15/04; E01F 15/0407; E01F 15/0415; E01F 15/0438; E01F 15/0461; E01F 15/08; E01F 15/088; E01F 15/145; E01F 15/146; E01F 15/0453; E01F 15/1461; E01F 15/086; E01F 15/0484; E01F 15/0423
See application file for complete search history.

(56) References Cited

U.S. PATENT DOCUMENTS 3,332,666 A * 7/1967 Gray ..... E01F 15/0415 256/13.1
3,385,564 A * 5/1968 Persicke ..... E01F 15/0415 256/13.1
3,436,057 A * 4/1969 Mazelsky ..... E01F 15/143 256/13.1
3,589,681 A * 6/1971 Ackerman ..... E01F 15/0415 256/13.1
3,638,913 A * 2/1972 Persicke ..... E01F 15/0415 256/13.1
4,822,206 A * 4/1989 Roussel ..... E01F 13/085 404/10
5,044,609 A * 9/1991 Cicinnati ..... E01F 15/04 256/13.1
5,826,861 A * 10/1998 Indge ..... B66F 17/003 256/1

(Continued)

FOREIGN PATENT DOCUMENTS

KR 100680819 B1 2/2007

*Primary Examiner* — Abigail A Risic
(74) *Attorney, Agent, or Firm* — Mark M. Friedman

(57) ABSTRACT

Disclosed is a shock absorber for buffering the barrier wall of a road. According to the present invention, a horizontal inner pipe bumper is inserted into a pedestal attached to a boundary of a barrier wall and joined to the support pillar. The buffer rail transversely connected to the protruding portion of the buffer pad on the front surface of the pedestal constitutes the buffer portion of the collision portion barrier wall, and when the buffer pad adhered to the inner pipe bumper is displaced upright, tension of the elastic rail connecting the buffer pad and the elastic rail block is generated, and the guard rail of the pillar is coupled to the barrier bridging body by a connecting member.

5 Claims, 7 Drawing Sheets

(56) References Cited

U.S. PATENT DOCUMENTS

| | | | | |
|---|---|---|---|---|
| 6,234,437 | B1 * | 5/2001 | Cabo | E01F 15/0461 248/200 |
| 6,551,012 | B1 * | 4/2003 | Hoebergen | E01F 15/0415 256/13.1 |
| 7,878,486 | B2 * | 2/2011 | Ochoa | E01F 15/0423 256/13.1 |
| 8,353,499 | B2 * | 1/2013 | Conway | E01F 15/0423 256/13.1 |
| 9,200,417 | B2 * | 12/2015 | Leonhardt | E01F 15/0461 |
| 9,863,106 | B2 * | 1/2018 | Conway | E01F 15/0423 |
| 2014/0319441 | A1 * | 10/2014 | Conway | E01F 15/0423 256/13.1 |

* cited by examiner

SHOCK ABSORBER OF ROAD

TECHNICAL FIELD

The present invention relates to a shock absorber on the road, and more particularly, to a shock absorber of barrier wall.

BACKGROUND

The present invention improves and extends the form and function of the pedestal shown in FIG. 2 of "Vehicle collision-absorbing protective (wall) separator on road" claimed by Korean Patent Application Publication No. 10-1997-0062203.

A barrier wall installed for a temporary use on a conventional road as a substitute for a guard rail has a disadvantage of being detached when a vehicle is impacted and invading a boundary line, but it is a risk factor for safety accidents because it is built in a temporary section which is broken or is being repaired.

Especially, it is essential to install a shock absorber in the danger zone during over speed collision such as steep slope, concrete barrier and electric pole. However, due to cost and other problems, many sections are left with a poor barrier.

Even if the guard rails and pillars are installed, if the safety is not sufficient due to frequent accidents or aging, the guard rail and support pillars must be shock absorbed. Nevertheless, it is frequently repaired with existing guard rails and repeated risk.

SUMMARY

In order to solve the problem of the above-described road barrier, the present invention is characterized in that an inner pipe bumper, which is a ground shaft support base inside a pedestal installed outside a boundary of a barrier wall, is coupled with a pillar. The impact of the barrier wall is absorbed by the tension of the elastic rail when the buffer pad is up-shifted due to the external force of the collision, and the guard rail of the pillar supporting pedestal is coupled to the various barrier bridging body with the connecting member to absorb shock.

The present invention has been made in view of the above-mentioned problems, and it is an object of the present invention to provide a safety barrier by buffering a collision portion of a barrier wall, and it can be installed at a low cost and selectively installed in a danger zone, and it is possible to easily replace aged guardrail by simple construction of a rigid coupling pillar, and it is possible to reduce the cost of construction have.

The present invention is a shock absorber capable of being applied to various barrier bridging body in various places such as a general work site or a driving practice field in addition to a construction section of a road side or a temporary dangerous section.

Figure 5:
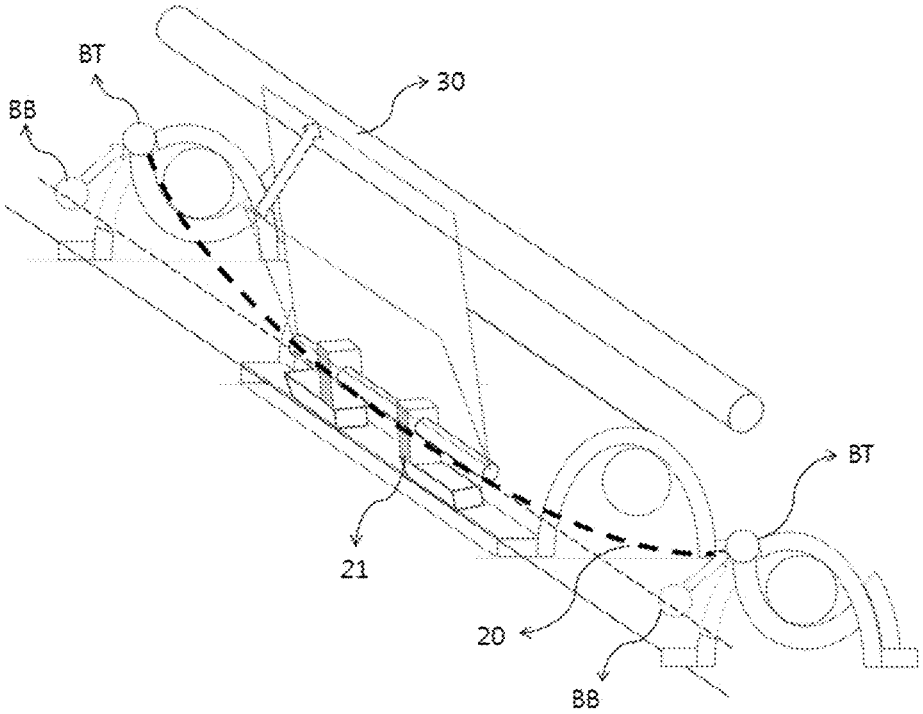
FIG. 5 is an operational exemplary view of the buffer pad of the shock absorber according to the present invention.

Description of symbols illustrated in FIG. 5

BB: The lowest displacement point of elastic rail

BT: The highest displacement point of elastic rail

DETAILED DESCRIPTION OF THE INVENTION

Now, embodiments of the present invention are described in detail with reference to the attached drawings.

Figure 1:
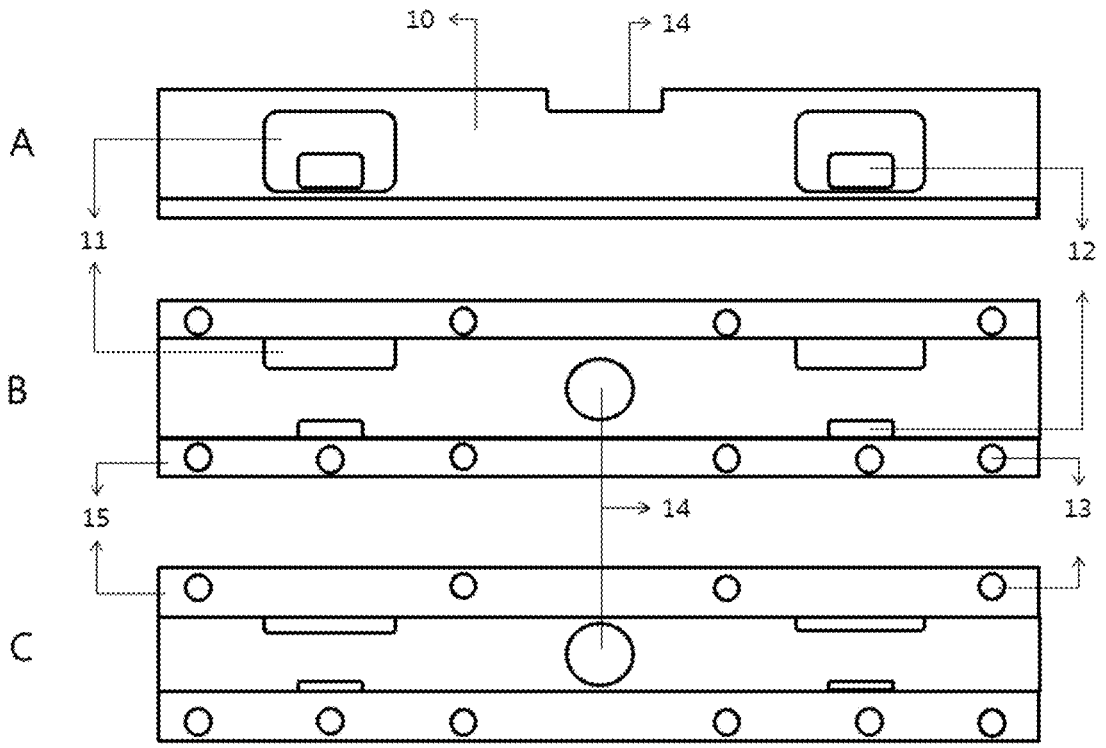
FIG. 1 is a front view (A), a top view (B) and a bottom view (C) of a pedestal of the shock absorber according to the present invention.

FIG. 1 is a front view (A), a top view (B), and a bottom view (C) of a pedestal of the present invention, The basic shape of the pedestal of the shock absorber of road is shown.

A buffer pad insertion hole 11 is formed at both ends on the front surface of the outer circumferential surface 10 of the pedestal, and the buffer pad fixing hole 12 is formed on the opposite rear side of each buffer pad insertion hole 11, and the pillar insertion hole 11 is formed at the upper center of the outer peripheral surface 10 of the pedestal, and the lower anchor panel 15 of the pedestal is formed with a plurality of anchor insertion hole 13 at appropriate intervals through which the anchor bolts 50 are inserted.

The buffer pad insertion hole 11 is formed so as to be spaced to the extent that the inserted buffer pad 60 is erected at the upper portion, and the buffer pad fixing hole is formed so that the protruding portion of the buffer pad 60 closely contacts. The number of buffer pad 60 and pillar insertion holes 14 is preferably formed in an appropriate number in proportion to the length of the pedestal.

Figure 2:
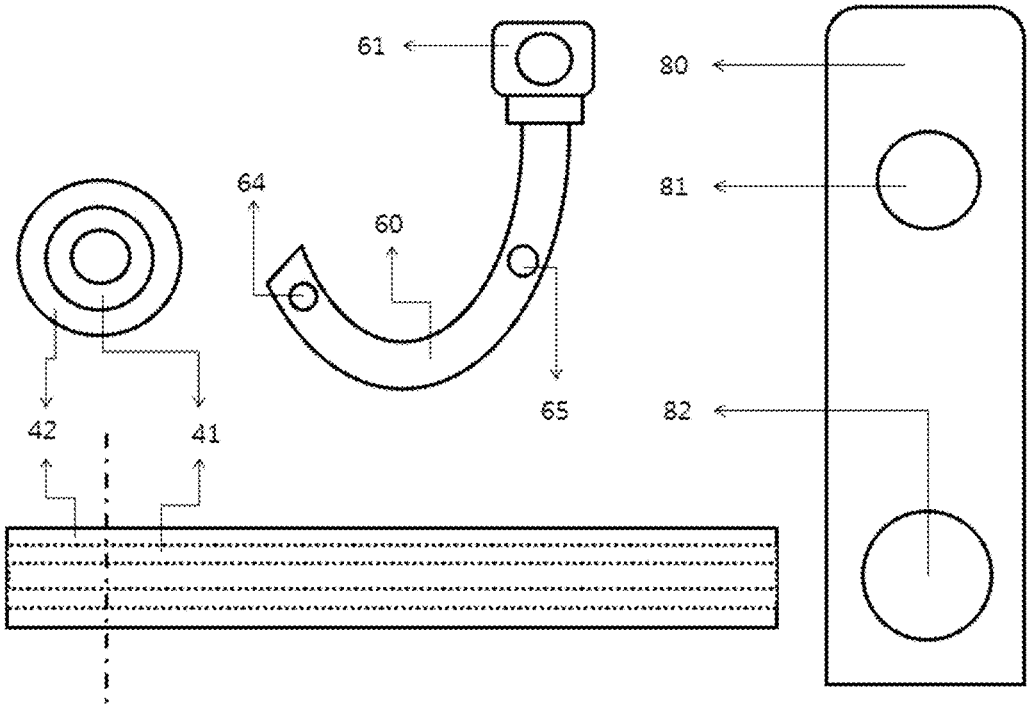
FIG. 2 is a front perspective view and side sectional view of the inner pipe bumper, a left side view of the buffer pad and side view of the supporting pillar of the shock absorber according to the present invention.

FIG. 2 is a front perspective view and side sectional view of the inner pipe bumper 40, a left side view of the buffer pad and side view of the supporting pillar of the shock absorber according to the present invention.

The inner pipe bumper 40 preferably has a durable steel pipe 41 and its surface is pressed with an elastic material 42 such as rubber or carbon fiber. It is formed so as to be in contact with the buffer pad at both ends of the pedestal at a density such that the inner pipe bumper 40 and the buffer pad 60 closely contact each other in the inner hollow portion of the pedestal.

A buffer pad socket 61 to which a buffer rail 30 is connected is coupled to a top end of a buffer pad 60 penetrating through the buffer pad insertion hole 11 and the buffer pad fixing hole 12, a rotary shaft through hole 64 is formed at one end of the buffer pad 60, and a buffer pad 60 protruding from the buffer pad insertion hole 11 is formed an elastic rail hole 65.

A guardrail through-hole 81 is formed in the upper portion of the support pillar 80, and an inner pipe through-hole 82 through which the inner pipe bumper 40 passes is formed in the lower portion of the support pillar 80.

Figure 3:
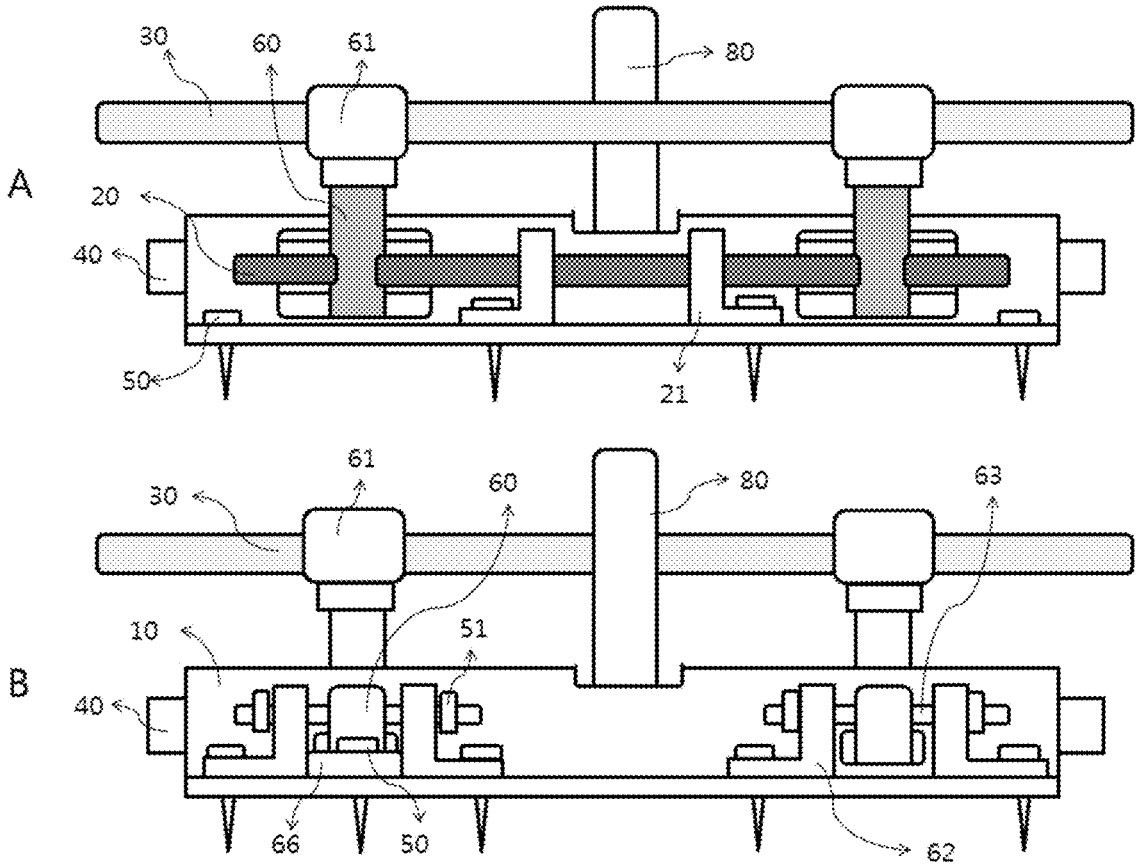
FIG. 3 is a front view (A) and a rear view (B) of the installation state of the shock absorber according to the present invention.

FIG. 3 is a front view (A) and a rear view (B) of the installation state of the shock absorber according to the present invention.

A transverse shaft guardrail 90 passing through a buffer pad socket 61 of a buffer pad 60 protruding from the buffer pad insertion hole 11 is overlapped and extended in front of the pedestal to form a buffering portion. The elastic rail block 21 at the center of the pedestal front side is fixed to the anchor panel 15 by anchor bolts 50, And the transverse axial elastic rails 21 pass through the elastic rail block 20 and the elastic rail through-holes 65 of the both-end buffer pads 60.

It is preferable that the elastic rail 20 is made of a steel material having elasticity that both ends are bent and restored from the fixed elastic rail block 21 by using reinforcing bars or durable elastic steels or the like.

In the back surface of the pedestal, a rotary shaft block 62, to which both ends of the rotary shaft 63 of the buffer pad 60 protruded to the buffer fixing hole 12 are coupled by a fixing nut 51, is fixed to the anchor panel 15 by an anchor bolt 50. Between the rotary shaft blocks 62, a support block 66 for supporting the downward pressure of the buffer pads 60, which are vertically fluctuated about the rotary shaft 63, is coupled by a lever effect.

Figure 4:
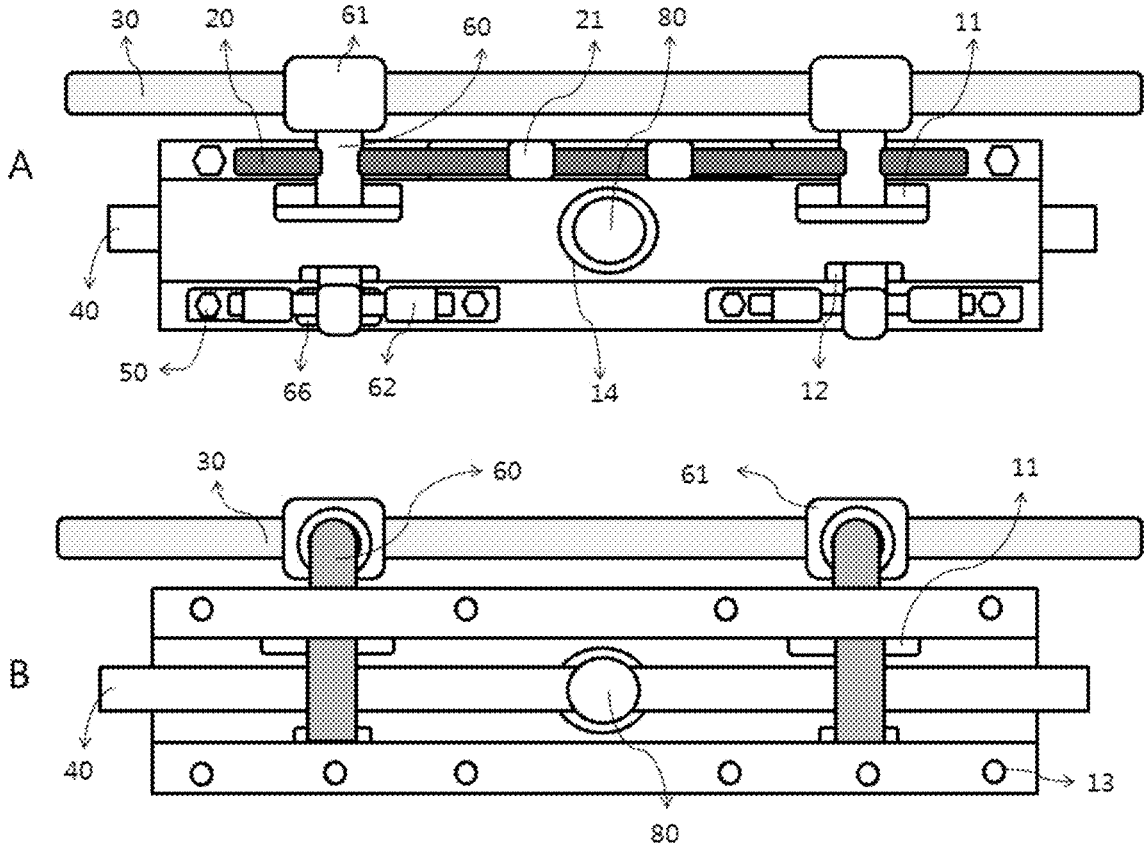
FIG. 4 is a top view (A) and a bottom view (B) of the installation state of the shock absorber according to the present invention.

FIG. 4 is a top view (A) and a bottom view (B) of the installation state of the shock absorber according to the present invention.

In the pillar 80, which is inserted upright into the pillar insertion hole 14 of the pedestal, the horizontal inner pipe bumper 40 inserted at the side of the pedestal penetrates through the inner pipe through hole 82 of the pillar 80.

In the case where the buried pillar is used as a support pillar 80, each inner pipe bumper 40 closely attached to the buffer pad of the pedestal hollow is inserted and constructed.

The buffer pad 60 of the pedestal is made of J-shaped steel, the nut type buffer socket 61 is coupled to the top of the buffer pad 60, and the buffer rail 30 adjacent to the impact side barrier is coupled so as to overlap and extend through the buffer pad socket 61.

FIG. 5 is an operational exemplary view of the buffer pad of the shock absorber according to the present invention.

The transverse axial buffer rail 30 passing through the buffer pad socket 61 of the buffer pad 60 is brought into contact with the collision portion barrier wall so that the buffer pad 60 fluctuates upright about the buffering rotary shaft 63 and compresses the adhered portion of the inner pipe bumper 40, An example in which the collision portion is buffered by the tension generated by bending the elastic rails 20 in the interval between the lowermost displacement point BB and the highest displacement point BT of the elastic rail 20 where the buffer pad 60 is erected.

Figure 6:
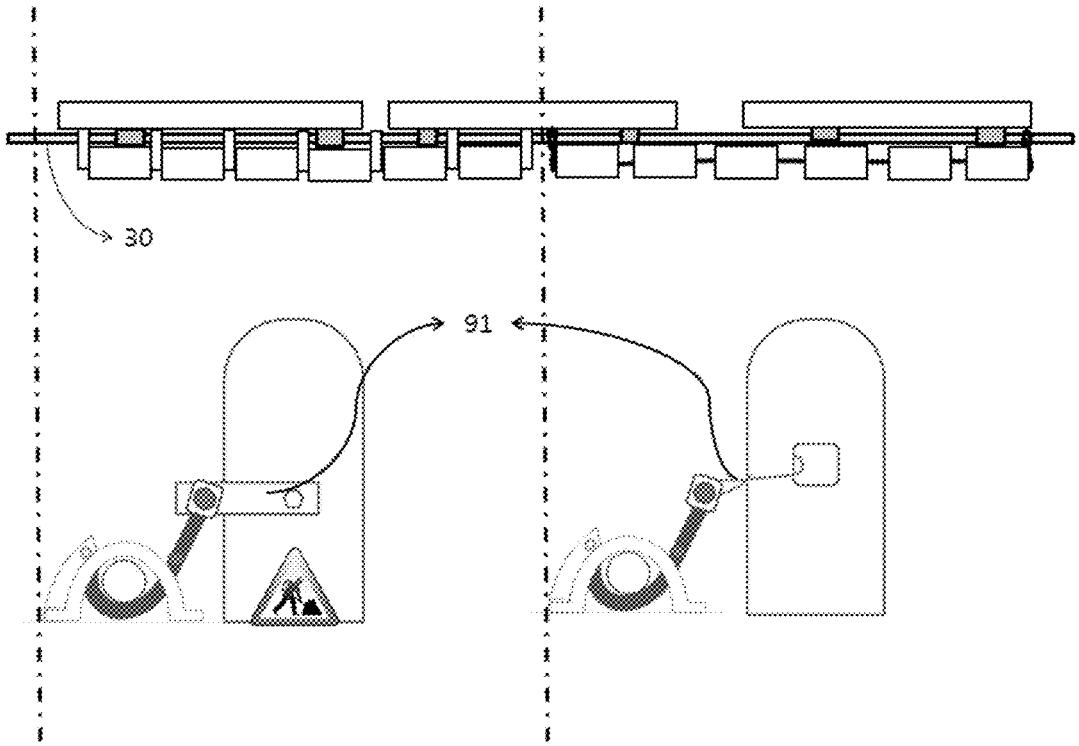
FIG. 6 is a top and left side exemplary view, in combination with a barrier wall showing examples of the shock absorber according to the present invention.

FIG. 6 is a top and left side exemplary view, in combination with a barrier wall showing examples of the shock absorber according to the present invention.

The buffer rail 30 of the pedestal is connected to a barrier wall by a connecting member 91 such as a connecting rod or a wire rope.

Figure 7:
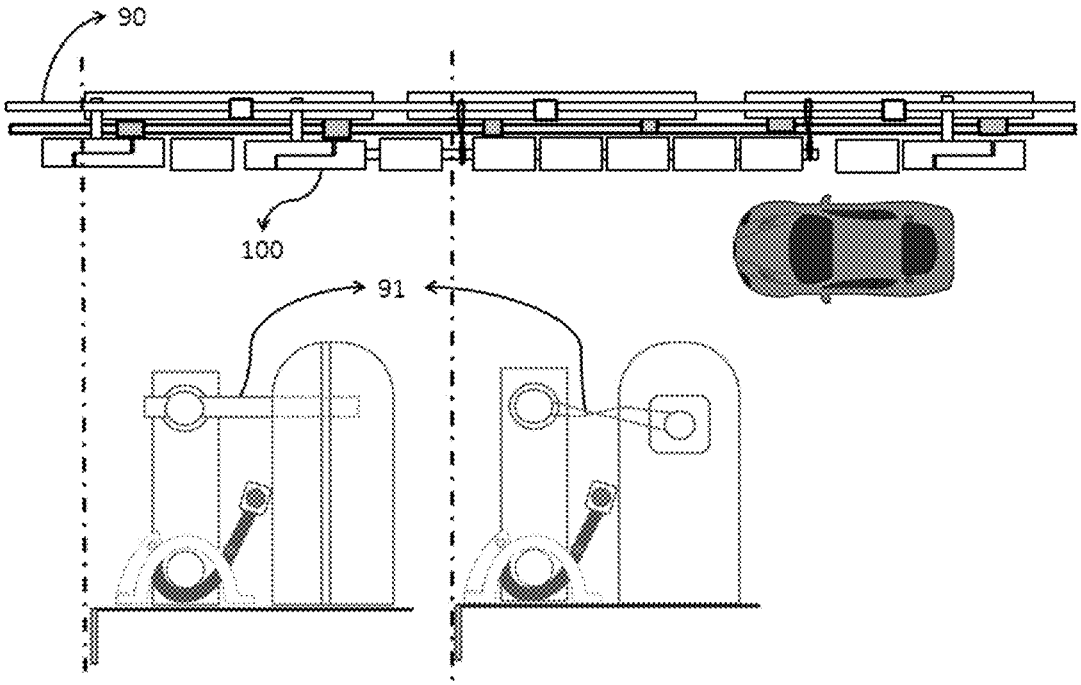
FIG. 7 is a top and left side exemplary view, in combination with a barrier bridging body showing examples of the shock absorber according to the present invention.

FIG. 7 is a top and left side exemplary view, in combination with a barrier bridging body showing examples of the shock absorber according to the present invention.

The barrier wall of the barrier bridging body 100 constituted by the rail-shaped members is coupled to the guard rail 90 of the support pillar 80 by a connecting rod, or the rail-shaped member of the barrier wall is coupled to the guard rail 90 of the support pillar 80 by wire rope or the like, Such as a connecting member 91.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A shock absorber comprising:

a pedestal having a buffer pad insertion hole (11) and a buffer pad fixing hole (12) formed on an outer circumferential surface (10) connecting anchor panels (15); and a buffer pad (60) adapted to be inserted into the buffer pad insertion hole (11) and protruded to the buffer pad fixing hole (12) provided in the pedestal, a rotary shaft (63) adapted to pass through the a rotary shaft through hole (64) provided in the buffer pad (60), wherein both ends of the rotary shaft (63) are horizontally connected to a rotary shaft block (62) provided in the pedestal, wherein the buffer pad (60) being up-shifted about the rotation axis (63) coupled to the rotation axis block (62) of the pedestal; and a buffer rail (30) transversely connected to a buffer socket (61) of the buffer pad (60), wherein the buffer pad (60) is up-shifted about the rotary shaft (63) of a rotary shaft block (62) when an external force applied on the buffer rail (30).

2. The shock absorber according to claim 1, further comprising an elastic rail block (21) fixed to the anchor panels (15) of the pedestal by an anchor bolts (50), and elastic rails (20) adapted to pass through the elastic rail block (21) and elastic rail-through holes (65) provided in the buffer pad (60).

3. The shock absorber according to claim 1, further comprising a pillar insertion hole (14) provided on the outer circumferential surface (10) of the pedestal, and a support pillar (80) inserted to the pillar insertion hole (14), wherein a guard rail (90) connected transversely through a guard rail through-hole (81) formed in the support pillar (80).

4. The shock absorber according to claim 3, wherein the buffer rail (30) or the guard rail (90) comprising a connecting member (91) to which a barrier wall is coupled.

5. The shock absorber according to claim 1, further comprising an inner pipe bumper 40 which is compressed by being in close contact with the buffer pad (60) and the pedestal when the buffer pad (60) is up-shifted.

* * * * *